US011573510B2

(12) United States Patent
Takahashi et al.

(10) Patent No.: US 11,573,510 B2
(45) Date of Patent: Feb. 7, 2023

(54) FIXING DEVICE

(71) Applicant: CANON KABUSHIKI KAISHA, Tokyo (JP)

(72) Inventors: Shuhei Takahashi, Chiba (JP); Shuichi Tamura, Ibaraki (JP); Tomoharu Kitajima, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/466,774

(22) Filed: Sep. 3, 2021

(65) Prior Publication Data

US 2021/0397116 A1 Dec. 23, 2021

Related U.S. Application Data

(63) Continuation of application No. PCT/JP2020/015125, filed on Mar. 26, 2020.

(30) Foreign Application Priority Data

Mar. 29, 2019 (JP) ..... JP2019-065188

(51) Int. Cl.
*G03G 15/20* (2006.01)

(52) U.S. Cl.
CPC ..... *G03G 15/2028* (2013.01); *G03G 15/2007* (2013.01); *G03G 15/2098* (2021.01)

(58) Field of Classification Search
CPC ..... G03G 15/2007; G03G 15/2098; G03G 15/2028
See application file for complete search history.

(56) References Cited

U.S. PATENT DOCUMENTS 5,296,906 A 3/1994 Hano et al. ..... 355/311
10,429,761 B2 10/2019 Takahashi ..... G03G 15/043
(Continued)

FOREIGN PATENT DOCUMENTS

CN 105269984 A * 1/2016 ..... B41J 11/007
JP S63-006473 U 1/1988
(Continued)

OTHER PUBLICATIONS

International Search Report and Written Opinion in counterpart International Application No. PCT/JP2020/015125, with English translation.

*Primary Examiner* — Victor Verbitsky
(74) *Attorney, Agent, or Firm* — Venable LLP

(57) ABSTRACT

A fixing device for fixing an image comprising a liquid developer on a recording material includes a feeding belt for feeding the recording material; a plurality of air vents, provided in a region of the feeding belt on which the recording material is fed, for sucking the recording material onto the feeding belt; a fan for sucking the recording material toward the feeding belt; and a heating source for heating the image on the recording material fed by the feeding belt, by radiant heat, and satisfies the following equation:

$$db \cdot \Phi b \cdot K < 44.9,$$

wherein
K: ρb·cb/λp·ρp·dp·cp
cp: specific heat of developer and recording material (J/g·K)
ρp: density of developer and recording material (g/cm3)
dp: thickness of developer and recording material (mm)
λp: thermal conductivity of developer and recording material (W/(m·K))
cb: specific heat of belt (J/g·K)
(Continued)

ρb: density of belt (g/cm3)
db: thickness of belt (mm)
Φb: diameter of air vent of belt (mm).

6 Claims, 5 Drawing Sheets

(56) References Cited

U.S. PATENT DOCUMENTS

| | | | | |
|---|---|---|---|---|
| 2013/0108337 | A1 | 5/2013 | Tamura | 399/328 |
| 2020/0150569 | A1 | 5/2020 | Yashiro et al. | G03G 15/2057 |
| 2020/0166877 | A1 | 5/2020 | Tamura et al. | G03G 15/2007 |
| 2021/0109466 | A1 | 4/2021 | Endo et al. | G03G 15/2098 |

FOREIGN PATENT DOCUMENTS

| | | |
|---|---|---|
| JP | H05-105260 | 4/1993 |
| JP | 2010-014804 | 1/2010 |
| JP | 2010-122568 | 6/2010 |
| JP | 2013-003441 | 1/2013 |
| JP | 2013-116638 | 6/2013 |
| JP | 2016-011184 | 1/2016 |
| JP | 2017-187739 | 10/2017 |

* cited by examiner

Q1:HEAT QUANTITY DIFFUSING IN DEVELOPER AND MEDIA
Q2:HEAT QUANTITY CONDUCTED TO FEEDING BELT SIDE

○:GLOSS DIFFERENCE OF 1° OR LESS
△:GLOSS DIFFERENCE OF 1° TO 2°
×:GLOSS DIFFERENCE OF 2° OR MORE

FIXING DEVICE

This application is a continuation of International Application No. PCT/JP2020/015125 filed Mar. 26, 2020, currently pending; and claims priority under 35 U.S.C. § 119 to Japan Application JP 2019-065188 filed in Japan on Mar. 29, 2019; and the contents of all of which are incorporated herein by reference as if set forth in full.

TECHNICAL FIELD

The present invention relates to a fixing device constituted by a heating source and a suction feeding belt.

BACKGROUND ART

The heating source is a means for heating an image forming material.

Further, the suction feeding belt is a means for sucking and feeding a recording material carrying the image forming material through holes perforated in the feeding belt.

As regards such a fixing device, conventionally, it has been known that there is a problem of image nonuniformity (uneven glossiness) due to air vents. As a means for solving such a problem, patent document 1 and patent document 2 have been known.

In Japanese Laid-Open Patent Application (JP-A) 2013-03441, by a constitution in which a position where a plurality of holes and paper contact each other is shifted for each of different feeding belts, the image nonuniformity due to the air vents is suppressed.

In JP-A 2013-116638, the influence of heat dissipation toward a belt side is alleviated by employing a constitution in which a suction feeding belt is heated.

SUMMARY OF THE INVENTION

Problem to be Solved by the Invention

However, a constitution in which the above-described image nonuniformity is reduced has been desired without increasing the number of component parts.

Therefore, it is an object of the present invention to provide a fixing device capable of reducing image nonuniformity without increasing the number of component parts.

Means for Solving the Problem

The present invention is a fixing device for fixing, on a recording material, an image comprising a liquid developer formed on the recording material comprising: a feeding belt for feeding the recording material; a plurality of air vents, provided in a region of the feeding belt on which the recording material is fed, for sucking the recording material onto the feeding belt; a fan for sucking the recording material toward the feeding belt; and a heating source for heating the image on the recording material fed by the feeding belt, by radiant heat, wherein the following equation is satisfied:

$$db \cdot \Phi b \cdot K < 44.9,$$

wherein

K: ρb·cb/λp·ρp·dp·cp cp: specific heat of developer and recording material (J/g·K)

ρp: density of developer and recording material (g/cm3)

dp: thickness of developer and recording material (mm)

λp: thermal conductivity of developer and recording material (W/(m·K))

cb: specific heat of belt (J/g·K)

ρb: density of belt (g/cm3)

db: thickness of belt (mm)

Φb: diameter of air vent of belt (mm).

Effect of the Invention

The fixing device according to the present invention is capable of reducing the image nonuniformity without increasing the number of component parts.

EMBODIMENTS FOR CARRYING OUT THE INVENTION

A fixing device according to the present invention is a fixing device which includes an electromagnetic wave irradiation device for irradiating a recording material on which a liquid developer comprising a colorant-containing resin material and a resin-containing carrier liquid is carried, with an electromagnetic wave which is a heating source, which includes a recording material feeding device provided with a sucking mechanism, and which satisfies db·Φb·K<44.9 (formula 1).

The carrier liquid is a volatile carrier liquid. The electromagnetic wave which is the heating source is infrared radiation (rays) or ultraviolet radiation (rays). The sucking mechanism is constituted by a feeding belt for feeding the recording material and a suction fan.

Then, by satisfying db·Φb·K<44.9 (formula 1), it is possible to reduce uneven glossiness due to air vents for suction provided in a region of the feeding belt on which the recording material is carried.

In the following, a display device according to the present invention will be described specifically with reference to the drawings. However, constituent elements described in this embodiment are merely examples and are not limited to those described in the embodiment.

First Embodiment (General Structure and Operation of Image Forming Apparatus)

Figure 1:
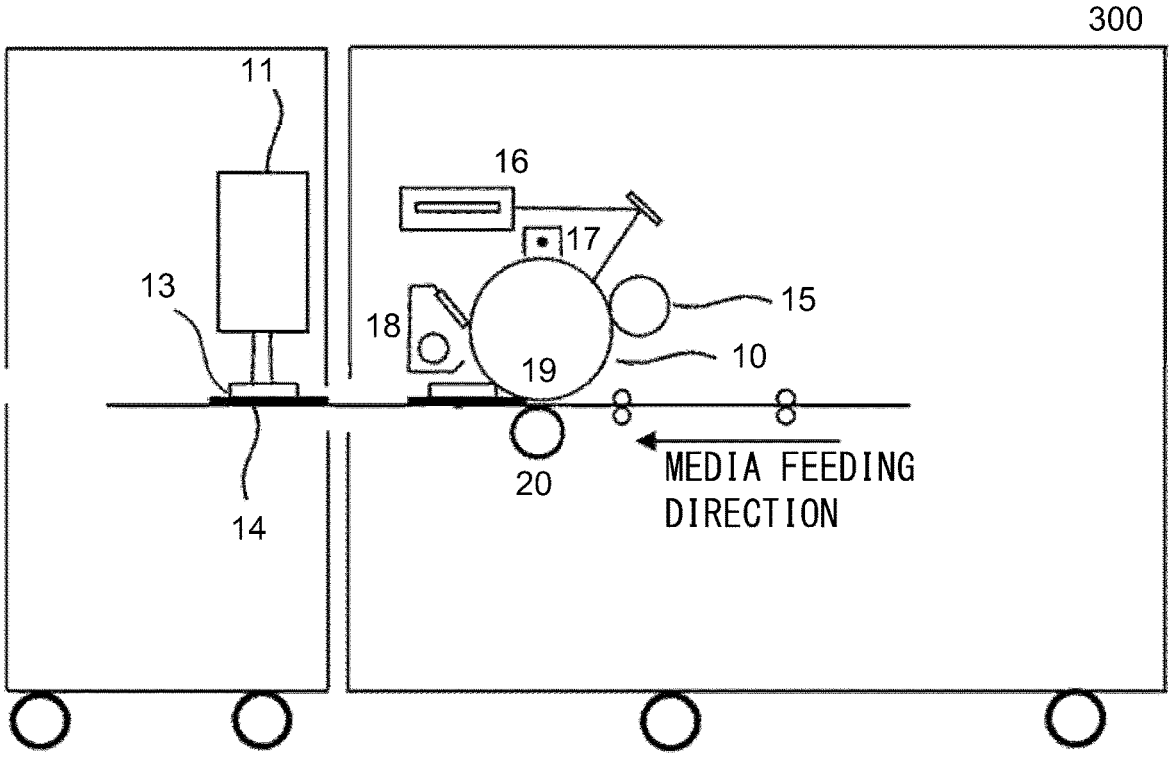
FIG. 1 is a sectional view showing a schematic structure of a fixing device according to an embodiment of the present invention.

FIG. 1 is a sectional view showing a schematic structure of an image forming apparatus 300 according to an embodiment 1.

Figure 2:
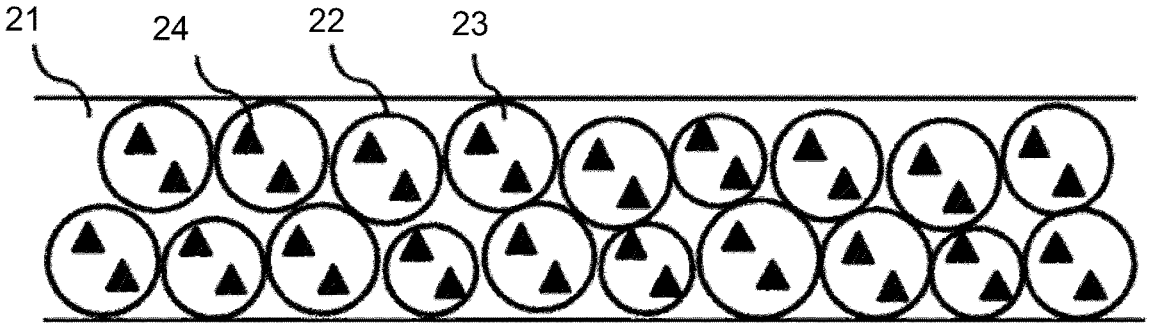
FIG. 2 is a view schematically representing a cross section of a liquid developer on a recording material according to the embodiment of the present invention.

The image forming apparatus 300 of this embodiment is a wet image forming apparatus of an electrophotographic type, using a liquid developer in which toner 22 is dispersed in a volatile carrier liquid 21 as shown in FIG. 2.

In this embodiment, an image forming unit 10 functions as an image forming portion for forming an image on a recording material 14 with use of a liquid developer 13. The image forming apparatus 300 includes, as an image bearing member for carrying an electrostatic latent image, a photosensitive drum 19 which is an electrophotographic photosensitive member of a rotatable drum type. The photosensitive drum 19 is rotationally driven counterclockwise as shown in FIG. 1. In the image forming apparatus 300, at a periphery of the photosensitive drum 19, is an order along a rotational direction of the photosensitive drum 19, the following devices are provided. First, a charger 17 as a charging means is disposed. Next, an exposure device 16 as an exposure means is disposed. The exposure device 16 forms the electrostatic latent image on the photosensitive drum 19 by irradiating a charged surface of the photosensitive drum 1 with light depending on image information.

Next, a developing device 15 as a developing means is disposed. The developing device 15 includes an accommodating portion (not shown) for accommodating a liquid developer and develops the electrostatic latent image on the photosensitive drum 19 with the liquid developer. Next, a transfer roller 20 as a transfer means is disposed. The transfer roller 20 is pressed toward the photosensitive drum 19 and forms an image.

Next, a cleaning device 18 as a cleaning means for the photosensitive member is disposed. The cleaning device 18 includes a cleaning blade disposed in contact with the surface of the photosensitive drum 19. The cleaning blade includes a rubber portion comprising an urethane rubber and a supporting portion comprising a metal plate or the like for supporting this rubber portion. The cleaning blade scrapes off the liquid developer remaining on the photosensitive drum 19 after primary transfer and removes the liquid developer from the photosensitive drum 19.

Further, the image forming apparatus 300 includes an intermediary transfer belt constituted by an endless-shaped belt (endless belt) as an intermediary transfer member so as to oppose the photosensitive drum 19 of the image forming unit 10, and may also form the image on the recording material via the intermediary transfer member.

(Liquid Developer)

FIG. 2 is a view schematic representing a cross section of the liquid developer on the recording material. A liquid developer 13 has a constitution in which toner 22 is dispersed in a carrier liquid 21. The toner 22 contains a pigment 24.

In this embodiment, the carrier liquid is a volatile carrier liquid 21. In this embodiment, when the recording material is outputted, the toner is fused while the carrier liquid 21 is evaporated. Incidentally, in the carrier liquid or the toner, a light-absorbing material for absorbing the electromagnetic wave and converting the electromagnetic wave into heat may also be mixed.

[Electromagnetic Wave Irradiation Device)

An electromagnetic wave irradiation device 11 uses, as a light source, a halogen heater, a quartz tube heater, or a ceramic heater which radiate infrared radiation (rays). Or, a UV-LED or the like radiating ultraviolet radiation (rays) is used. In the electromagnetic irradiation device, a single light source is provided, but a plurality of light sources may also be arranged in a feeding direction. A wave length of the electromagnetic wave can also be selected in conformity to the light-absorbing material, contained in the carrier liquid or the toner, for absorbing and converting the electromagnetic wave into heat.

(Recording Material Feeding Device)

Figure 3:
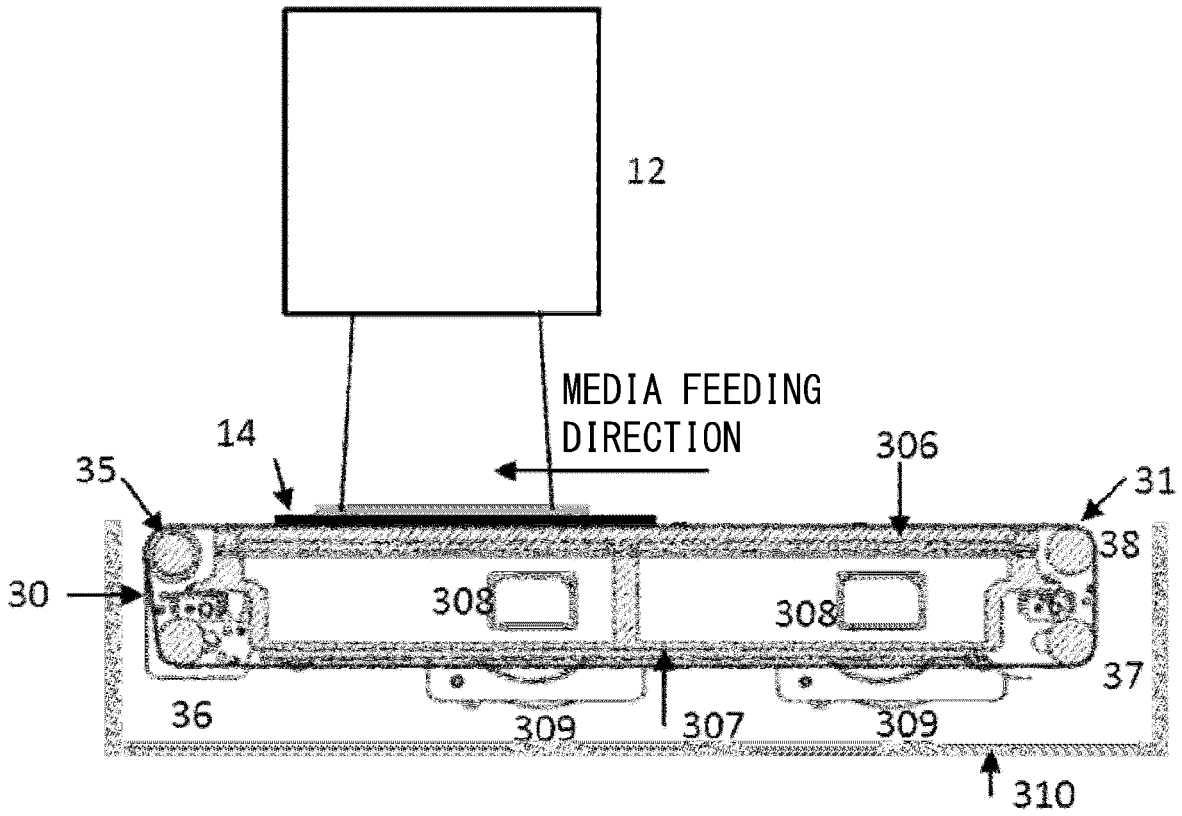
FIG. 3 is a sectional view of a recording material feeding device according to the embodiment of the present invention and an electromagnetic wave irradiation device.

FIG. 3 is a sectional view of a recording material feeding device 30 and an electromagnetic wave irradiation device 12.

First, the recording material feeding device 30 will be described using FIG. 3.

The recording material feeding device 30 is a unit for carrying and feeding the recording material 14 on which an unfixed developer is carried is placed by the transfer portion and for delivering the recording material 14 to a subsequent discharging unit.

The recording material feeding device 30 includes an endless feeding belt 31 provided with many air vents, and a driving roller 35 and follower rollers 36, 37 and 38 which stretch this feeding belt 31. The feeding belt 31 rotates in a direction of an arrow R2 in the figure by a driving motor (not shown) via the driving roller 35. The feeding belt 31 is provided with the air vents uniformly within a region (within a maximum width region of the recording material) in which the recording material is capable of being carried in a direction perpendicular to a movement direction of the feeding belt 31. In this embodiment, the air vents are provided over an entire circumference of the feeding belt 31 at predetermined intervals with respect to each of the movement direction of the feeding belt 31 and the direction perpendicular to the movement direction.

The feeding belt 31 in this embodiment is 350 mm in width and 900 mm in peripheral length. As a material thereof, an ethylene-propylene-dien rubber or a polyimide resin material is employed. The feeding belt 31 rotates at a peripheral speed of 1000 mm/sec. Inside the feeding belt 31, an air sucking system is provided.

As details of the air sucking system, a perforated suction plate 306 and a box 307 which is fixed intimately to the perforated plate and which comprises a heat-resistant resin material are disposed. The suction box 307 comprising the heat-resistant resin material is provided with two chambers each to which a duct 308 through which air passes is connected, and to an end of the duct 308, a fan 309 is mounted. Further, the perforated suction plate 306 is fixed at a surface thereof to an inside of the feeding belt 31 so as to slidable on the feeding belt 31.

That is, the suction fan sucks the air from an upper surface side of the feeding belt 31 and always forms an air flow toward a rear direction. Then, when the recording material 14 to be fed reaches on the feeding belt 31, the feeding belt 31 attracts and feeds the recording material 14 at an upper surface thereof forming a side (back side) of the recording material 14 where there is no unfixed image.

The recording material feeding portion 30 carries, on the feeding belt 31, the recording material 14 on which the image 15 is formed by the image forming portion 10, and feeds the recording material 14 so as to pass below an ultraviolet irradiation device 12.

(Temperature Difference of Developer)

Figure 4:
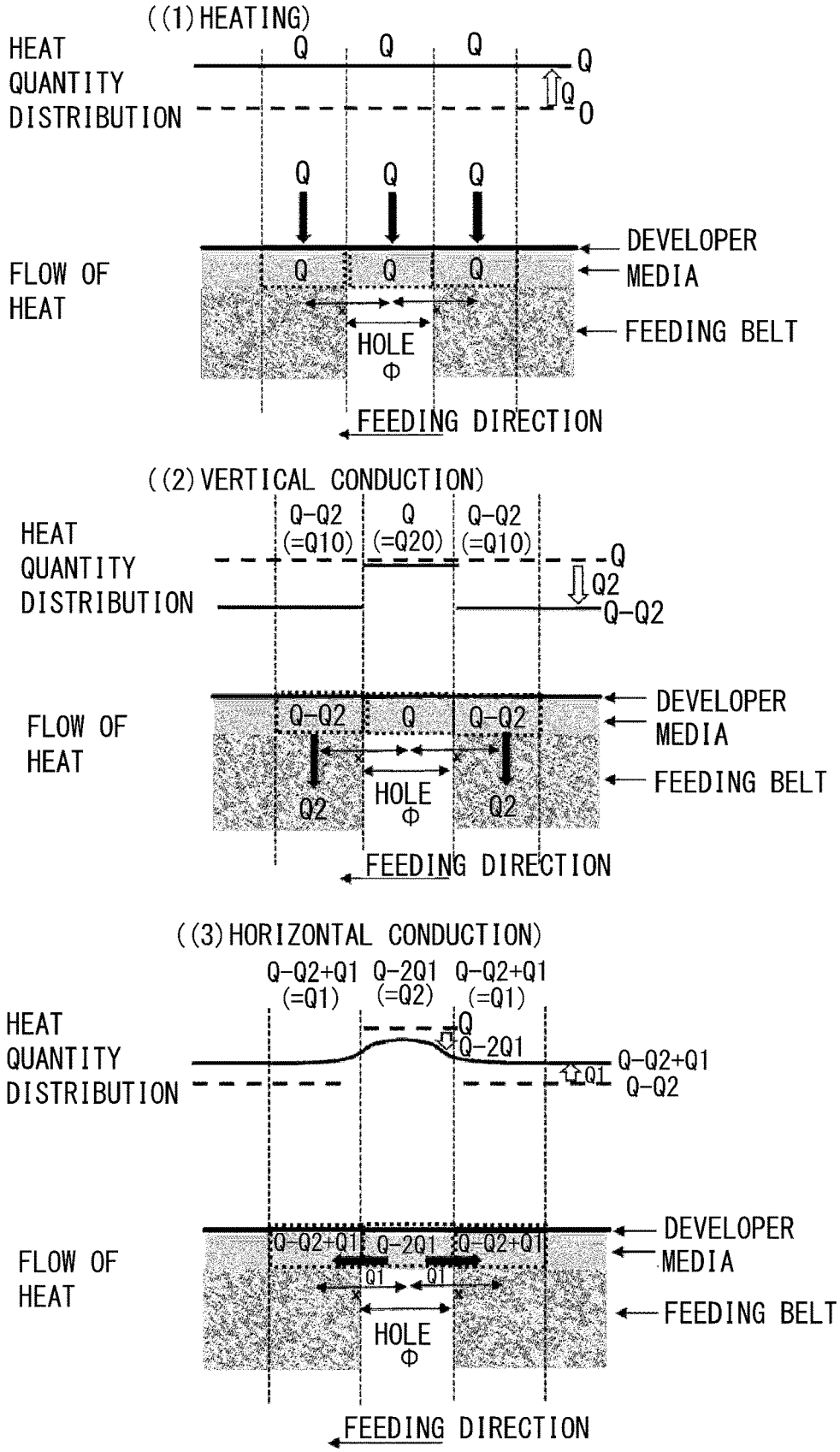
FIG. 4 is a view for illustrating a temperature difference of a developer according to the embodiment of the present invention.

FIG. 4 is a view for illustrating (1) radiation, (2) vertical transmission/conduction to recording material feeding direction, and (3) "flow of heat" and "heat quantity distribution" of developer in each of thermal movements of horizontal conduction to recording material feeding direction.

First, the developer and the recording material are heated by the heating source ((1) radiation). Objects to be heated are the developer and the recording material, but in the following, the recording material will be omitted and inclusively referred to as the developer. Further, in the following, a thermal capacity and a heat quantity of the developer are described, but mean a total thermal capacity and a total heat quantity of the developer and the recording material. Subsequently, the heat transmits/conducts onto the air vents and a belt direction at a periphery of the air vents (air direction on the air vents) ((2) vertical transmission/conduction to recording material feeding direction). The air does not readily transmit, and therefore, it would be considered that a heat quantity difference generates between on the air vents and the periphery of the air vents. Due to this heat quantity difference, a difference in developer temperature generates between on the air vents and the periphery of holes, and therefore, it would be considered that thermal conduction occurs ((3) horizontal) conduction to recording material feeding direction.

In the following, details will be described. The developer is heated by a heat quantity Q by the heating source. Accordingly, a developer heat quantity at an air vent position and a developer heat quantity at the periphery of the air vents are also Q. Accordingly, a developer temperature at the air vent position is T=Q/Cp, and a peripheral developer temperature T is T=(formula 2)=Q/Cp. In this embodiment, as in FIG. 4, an area of the "air vent position" is ½ of an area of the "air vent peripheral position", and therefore, when a thermal capacity at the air vent position is Cp, a thermal capacity at the periphery of holes is 2Cp.

$$2Q/2Cp \quad \text{(formula 2)}$$

The air vent position would be considered as being small because the thermal transmission is one against air, so that the heat quantity at the air vent position is still approximately Q, and a air vent position developer temperature T=Q/Cp (=$T_{20}$). The peripheral developer temperature is T=(formula 3)=(formula 4) due to (2) transmission/conduction difference, and (formula 4)=$T_{10}$.

$$(2Q-2Q_2)/2Cp \quad \text{(formula 3)}$$

$$(Q-Q_2)/Cp \quad \text{(formula 4)}$$

Thus, due to (2) transmission/conduction toward the belt direction, a developer temperature $T_{20}$ (=(Q/Cp)) at an upper portion of the air vents becomes higher than a developer temperature $T_{10}$ (=(formula 4)) at the periphery of the air vents. Accordingly, the heat quantity of the developer at the air vent P diffuses to the periphery. When this heat quantity diffused is $Q_1$, (formula 5) holds from equation of heat (thermal) conduction. A is a constant. $T_{20}$ is the developer temperature on the air vents after (2) transmission/conduction toward the belt direction, and $T_{10}$ is the developer temperature at the periphery of the air vents. When a distance x in which a temperature gradient occurs ranges from a center of the hole to a hole end (portion), the distance x is (D/2 ((D is a diameter of the air vent), and (formula 6) holds.

$$Q_1=A\lambda p(T_{20}-T_{10})/x \quad \text{(formula 5)}$$

$$Q_1=2A\lambda p(T_{20}-T_{10})/\Phi \quad \text{(formula 6)}$$

When the developer temperature at the upper portion of the air vents after (3) conduction is $T_2$ and the developer temperature at the peripheral portion of the holes is $T_1$, a developer temperature difference ΔT is $\Delta T=T_2-T_1$ $T_2$ is after (3) conduction of FIG. 4, and therefore, the heat quantity of the developer on the air vents is $Q-2Q_1$, and the heat quantity at the periphery of the air vents is $2(Q-Q_2+Q_1)$. Accordingly, the developer temperature $T_2$ on the air vents is $T_2=(Q-2Q_1)/Cp$, and the developer temperature at the periphery of the air vents is $T_1=2(Q-Q_2+Q_1)/2Cp$. Accordingly, $\Delta T=T_2-T_1$=(formula 7)=(formula 8). $Q_1$ is the heat quantity permitting the thermal (heat) conduction, and therefore, $Q_1$ is proportional to λ/Φ.

$$(Q-2Q_1)/Cp-(Q-Q_2+Q_1)/Cp \quad \text{(formula 7)}$$

$$(-3Q_1+Q_2)/Cp \quad \text{(formula 8)}$$

$Q_2$ is a flow of the heat conducting from the developer toward the belt. As regards $Q_2$, it is confirmed that sensitivity to thermal conductivity dependency of the feeding belt is small and that the heat quantity of the feeding belt is dominant, and it is considered that $Q_2$ is roughly proportional to a thermal capacity Cb of the belt (proportionality constant is B) ($Q_2$=B·Cb).

The temperature difference $\Delta T=T_2-T_1$=(formula 8)=(formula 9). ΔT has negative correlation to $Q_1$ from the (formula 8), and therefore, it is assumed that the temperature difference is $\Delta T=D(Cp/Q_1)$ (D is proportionality constant), and then ΔT was calculated. When the thermal capacity Cp (Cp=mpcp) and the (formula 6) are inputted to $\Delta T=(Cp/Q_1)$, ΔT=(formula 9) holds ($Q_1$ is the above-described $Q_1$ (formula 6), and Cp=mp·cp was used). However, in the case where a (film) thickness of the developer is thin relative to paper, a physical property value of the recording material is dominant, and therefore, a physical property of the recording material was used. However, this case is the case where the developer thickness is not more than 1/10 of the thickness of the paper. In the case where the developer thickness is more than 1/10 of the thickness of the paper, an average of the sum of the developer and the physical property value of the recording material is used.

$$(DB/2A)\cdot db\cdot\Phi b\cdot K \quad \text{(formula 9)}$$

K: ρb·cb/λp·ρp·dp·cpmp: specific heat weight per unit area between developer and recording material (g/cm$^2$) cp: specific heat of developer and paper (J/g·K)

ρp: density of developer and recording material (g/cm$^3$)

dp: thickness of developer and recording material (mm), and a relationship of mp=ρdp holds.

λp: thermal conductivity of developer and recording material (W/(m.K))

cb: specific heat of belt (J/g·K)

ρb: density of belt (g/cm$^3$)

db: thickness of belt (mm), and a relationship of mb=ρbdb holds.

Figure 5:
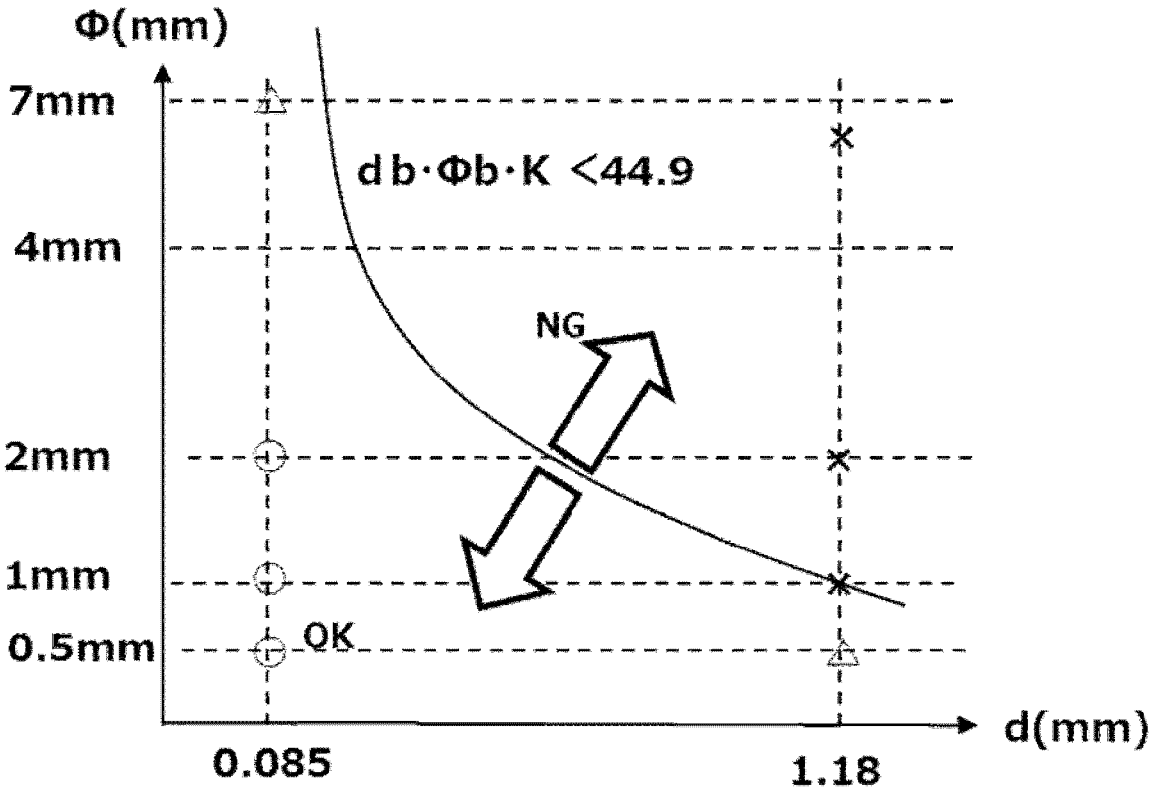
FIG. 5 is a view in which a relationship, between a (film) thickness of a feeding belt and a hole diameter p of the feeding belt, for providing a glass difference of 2° or less is plotted in the embodiment of the present invention.

In the case where ΔT is constant, a glass difference ΔG is determined at a certain value. In FIG. 5, db and Φp are inversely proportional to each other, and therefore, it is considered that the above-described assumption of $\Delta T=D(Cp/Q_1)$ (D is proportionality constant) is appropriate. The glass difference ΔG is proportional to db·Φb·K. Accordingly, in order to make the glass difference ΔG not more than a certain value, there is a need that db·Φb·K is made smaller than 44.9 (db·Φb·K<44.9 (formula 1)).

(Result of Developer Temperature (Difference))

FIG. 5 is a view in which a relationship, between the thickness db of the feeding belt and the hole diameter Φb of the feeding belt, for making the glass difference not more than an allowable range is plotted. ○ represents the case where the glass difference is 1° or less and the glass difference is incapable of being visually recognized. Δ represents a range in which the glass difference 1° to 2° and capability or incapability of visual recognition varies. X represents the case where the glass difference is 2° or more and is capable of being visually recognized. This example is the case where as the recording material, polyethylene terephthalate (PET) is used.

Thermal conductivity $\lambda=0.31$ ((W/m·K))

Specific heat cp=1.26 (J/(g·K))

Specific gravity $\rho p=1.57$ (g/cm$^3$)

Thickness $dp=7\times10^{-2}$ (mm)

As the feeding belt, ethylene propylene diene rubber (EPDM) was used.

Specific gravity $\rho b=0.86$ (g/cm$^3$)

Specific heat cb=1.6 (J/(g·K))

In order to make the glass difference ΔT not more than 2°, there is a need to satisfy the (formula 1) (FIG. 5). The gloss (glossiness) in this embodiment is 60° gloss using PG-1M manufactured by NIPPON DENSHOKU INDUSTRIES Co., Ltd. This method is in conformity to JIS Z 8741. Φ may preferably be 0.5 mm or more from the viewpoint of clogging of paper powder or the like. The hole diameter Φ is not limited to one of a true circle, and is a distance to a maximum diameter. In this embodiment, in order to make an attraction force necessary to suck and feed the recording material 200 Pa or more, an opening (aperture) ratio of the holes is required to be 0.4% or more. In the case where the hole diameter is 0.5 mm, a pitch between holes is 9.5 mm. Accordingly, a ratio of interference between the temperatures of the developer and the recording material at an interval between adjacent holes is negligible. Here, the hole diameter is an average of those of 20 holes.

The developer in this embodiment may also be ink comprising a pigment and a volatile carrier liquid or comprising a pigment and an ultraviolet curable liquid. The volatile carrier liquid may only be required to be a liquid, such as mineral oil or silicone oil, which is liable to volatilize and electrically insulative. However, the volatile carrier liquid is not limited to the above-described ones if the above-described condition is satisfied. The ultraviolet curable resin may only be required to be one in which a liquid monomer of an acrylate type or a vinylether type contains a polymerization initiator for absorbing the ultraviolet radiation and for starting polymerization. When the ultraviolet curable resin is not limited to the above-described monomer if the ultraviolet curable resin is cured by the ultraviolet radiation. (Second embodiment)

Figure 6:
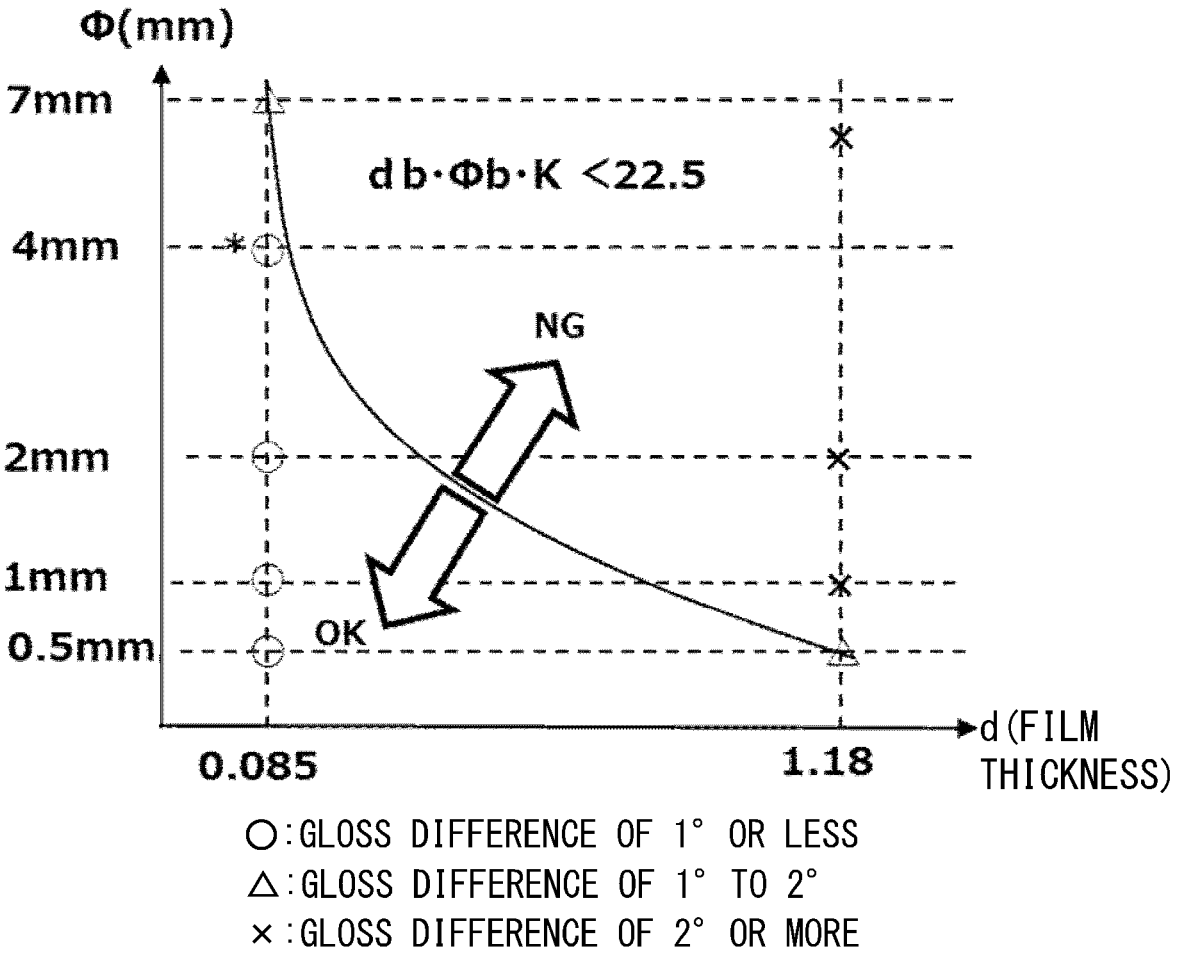
FIG. 6 is a view in which a relationship, between the thickness of the feeding belt and the hole diameter of the feeding belt, for providing a glass difference of 1° or less is plotted in an embodiment of the present invention.

FIG. 6 is a view in which a relationship, between the thickness d (mm) and the hole diameter φ (mm) of the feeding belt, for making the glass difference 1° or less is plotted. As the recording material, polyethylene terephthalate (PET) is used. Specifically, a belt in a range of a curve in which the thickness d (mm) of the feeding belt and the hole diameter φ (mm) fall with a lower left range of the curve may only be required.

The range shown in the embodiment is the case where polyethylene terephthalate (PET) is used as the recording material and EPDM is used as the feeding belt. Physical properties of the polyethylene terephthalate (PET) and EPDM are the same as those in the first embodiment.

In the second embodiment, different from the first embodiment, the case of a recording material which has a rough surface property and which is low in gloss is employed. Specifically, the case where the gloss is 30 or less is employed. When the gloss becomes 300 or less, the gloss is capable of being visually recognized even when an absolute value thereof is small and even 1° or more, and therefore, there is a need that the glass difference is made 1° or less. In order to make the glass difference 1° or less, db·Φb·K<22.5 may only be satisfied.

In the second embodiment, db·Φb·K<22.5 is satisfied, so that the glass difference can be made 1° or less, and therefore, it becomes difficult to visually recognize the glass difference even when the recording material rough in surface property and low in gloss is used.

INDUSTRIAL APPLICABILITY

According to the present invention, there is provided an image forming apparatus capable of reducing image non-uniformity without increasing the number of component parts.

The present invention is not restricted to the foregoing embodiments, but can be variously changed and modified without departing form the spirit and the scope of the present invention. Accordingly, the following claims are attached hereto make public the scope of the present invention.

This application claims the Conventional Priority from Japanese Patent Application 2019-065188 filed Mar. 29, 2019, all disclosure of which is incorporated by reference herein.

The invention claimed is:

1. A fixing device for fixing, on a recording material, an image comprising a liquid developer formed on the recording material, comprising:

a feeding belt for feeding the recording material;

a plurality of air vents, provided in a region of said feeding belt on which the recording material is fed, for sucking the recording material onto said feeding belt;

a fan for sucking the recording material toward said feeding belt; and a heating source for heating, by radiant heat, the image on the recording material fed by said feeding belt, wherein the following equation is satisfied:

$$db\cdot\Phi b\cdot K<44.9,$$

wherein

K: ρb·cb/λp·ρp·dp·cp cp: specific heat of developer and recording material (J/g·K)

ρp: density of developer and recording material (g/cm3)

dp: thickness of developer and recording material (mm)

λp: thermal conductivity of developer and recording material (W/(m·K))

cb: specific heat of belt (J/g·K)

ρb: density of belt (g/cm3)

db: thickness of belt (mm)

Φb: diameter of air vent of belt (mm).

2. A fixing device according to claim 1, wherein db·Φb·K<22.5.

3. A fixing device according to claim 1, wherein said heating source radiates infrared radiation.

4. A fixing device according to claim 3, wherein said feeding belt is an ethylene-propylene-dien rubber.

5. A fixing device according to claim 3, wherein said feeding belt is a polyimide resin material.

6. A fixing device according to claim 1, wherein the liquid developer includes a carrier liquid and toner.

* * * * *